US006976376B2

(12) United States Patent
Sundgren et al.

(10) Patent No.: US 6,976,376 B2
(45) Date of Patent: Dec. 20, 2005

(54) APPARATUS AND METHOD FOR QUENCHING THIN-WALLED METAL HOLLOW CASING

(75) Inventors: Anders Sundgren, Sunderbyn (SE); Göran Berglund, Gammelstad (SE); Mats Lindberg, Luleå (SE)

(73) Assignee: Accra Teknik AB, Ojebyn (SE)

( * ) Notice: Subject to any disclaimer, the term of this patent is extended or adjusted under 35 U.S.C. 154(b) by 219 days.

(21) Appl. No.: 10/277,611

(22) Filed: Oct. 22, 2002

(65) Prior Publication Data

US 2003/0090032 A1 May 15, 2003

(30) Foreign Application Priority Data

Oct. 22, 2001 (SE) ..... 0103510

(51) Int. Cl.[7] ..... C21D 8/10
(52) U.S. Cl. ..... 72/61; 72/62
(58) Field of Search ..... 72/61, 62; 425/526; 65/267; 249/79; 148/593

(56) References Cited

U.S. PATENT DOCUMENTS

| | | | | | |
|---|---|---|---|---|---|
| 2,050,227 | A | * | 8/1936 | Mantle | 72/59 |
| 3,396,002 | A | * | 8/1968 | Johan | 65/267 |
| 3,832,877 | A | * | 9/1974 | Tominaga et al. | 72/62 |
| 3,919,871 | A | * | 11/1975 | Andrasev | 72/62 |
| 4,872,827 | A | * | 10/1989 | Noda | 425/526 |
| 5,190,715 | A | * | 3/1993 | Yamada et al. | 425/526 |
| 5,214,948 | A | * | 6/1993 | Sanders et al. | 72/62 |
| 5,419,171 | A | * | 5/1995 | Bumgarner | 72/62 |
| 5,435,163 | A | * | 7/1995 | Schafer | 72/62 |
| 6,261,392 | B1 | | 7/2001 | Sundgren et al. | |

FOREIGN PATENT DOCUMENTS

| | | | | | |
|---|---|---|---|---|---|
| EP | 1 015 645 | B1 | | 2/2002 | |
| GB | 1 490 535 | | | 11/1977 | |
| JP | 62259230 | A | * | 7/1966 | B21D 26/02 |
| JP | 55048430 | A | * | 4/1980 | B21D 26/02 |
| JP | 09070876 | A | * | 3/1997 | B29C 49/06 |
| JP | 2000289028 | A | * | 10/2000 | B29C 33/04 |
| SE | 64771 | | | 2/1927 | |

* cited by examiner

*Primary Examiner*—Robert B. Davis
(74) *Attorney, Agent, or Firm*—Ware, Fressola, Van der Sluys & Adolphson LLP

(57) ABSTRACT

In an apparatus for quenching thin walled metal hollow casings (6) manufactured by blow molding, the apparatus has a molding tool (1) defining a slot or aperture (21) and a delivery system for applying a coolant to the slot or aperture (21) of the molding tool (1). In a method of applying a coolant to the external surface of a blow molded casing (6), the coolant is applied onto an external surface of the casing (6) after the casing (6) has been formed against a tool (1) which includes at least one slot or aperture (21).

15 Claims, 3 Drawing Sheets

APPARATUS AND METHOD FOR QUENCHING THIN-WALLED METAL HOLLOW CASING

BACKGROUND OF THE INVENTION

1. Technical Field

The present invention relates to an apparatus and method for quenching thin walled metal hollow casings and in particular to an apparatus and method for quenching thin walled metal hollow casings manufactured by blow molding.

2. Description of the Background Art

The inventor of the present invention has applied for a patent entitled "A method for manufacturing thin walled metal hollow casing by blow moulding" in a number of territories including U.S.A. with U.S. patent application Ser. No. 09/424,235 (now U.S. Pat. No. 6,261,392 issued Jul. 17, 2001) and Europe with European Patent Application No. 98919699.3 and the present application discloses an improvement to inventions in this general area. After considerable testing of the method disclosed in the above referenced application in combination with a review of blow molding processes described in the prior art, an improved apparatus and method have been invented which overcome a number of inherent problems with previous methods of quenching blow molded thin walled metal hollow casings.

The cooling processes used in methods disclosed in the prior art do not provide even cooling to the preheated casing. Cooling occurs more rapidly on regions of the external surface of the casing which are proximal to cooling channels provided on a number of the molding tools of the prior art thereby effecting the quality of the blow molded casing. The speed of the cooling process also needs to be optimized in order to improve the efficiency of the manufacturing method.

SUMMARY OF THE INVENTION

It is an object of the present invention to provide an apparatus and method for applying a cooling medium over a substantial portion of the external surface of a blow-molded casing and to improve the efficiency of such manufacturing methods.

Accordingly, the present invention provides an apparatus for applying a cooling medium to an external surface of a blow molded casing characterized in that the apparatus comprises a molding tool defining a slot or aperture and a means for delivering a cooling medium to the slot or aperture of the molding tool. The slot or aperture exposes a substantial portion of the external surface of the blow-molded casing and the medium is in direct contact with the surface.

Ideally, the tool defines a plurality of slots or apertures. This increases the surface area of the casing to which a cooling medium is directly applied.

Ideally, the delivery means is provided by a pipe and a dispenser. This apparatus provides a simple and cost effective method of applying gas or liquid coolant to the external surface of the casing.

Preferably, the delivery means has a plurality of dispensers aligned with and located adjacent the slots or apertures of the tool. This facilitates instant application of coolant to the exposed external surfaces of the casing.

Ideally, the tool includes a chamber in fluid communication with the slot or aperture. This allows a gas to be inserted into the chamber when used as the cooling medium. It will of course be appreciated that both gas and liquid coolants may be dispensed onto the exposed external surfaces of the casing simultaneously or in sequence. The simple pipe and dispenser apparatus housed within the chamber allows water to be initially flushed onto the casing in addition to gas being injected into the chamber.

Preferably, the delivery means is provided by pipes, one pipe having an inlet valve and another pipe having an outlet valve Ideally, the valves are in fluid communication with the chamber.

In one embodiment, the tool is provided by two partible halves which combine to form a helical pipe. In this embodiment, the surface area of the tool supporting the casing is reduced to a minimum. The surface area of the tool serves only to support the desired shape of the casing.

Preferably, the helical pipe is hollow and transports a cooling/heating medium internally.

Accordingly, there is also provided a method of applying a cooling medium to an external surface of a blow molded casing characterized in that said cooling medium is delivered onto an external surface of the casing after the casing has been formed against a tool defining a slot or aperture.

Preferably, the cooling medium is a liquid such as water and it is sprayed/flushed directly onto exposed surfaces of the casing.

Ideally, the cooling medium is a gas and it is injected into a chamber of the tool.

Preferably, the gas is removed from the chamber of the tool by a vacuum means prior to the separation of the tool for removal of the casing.

BRIEF DESCRIPTION OF THE DRAWINGS

The invention will now be described with reference to the accompanying drawings, which show, by way of example only, two embodiments of an apparatus and method for quenching thin walled metal hollow casings manufactured by blow molding in accordance with th invention. In the drawings.

DETAILED DESCRIPTION OF THE INVENTION

Figure 1:
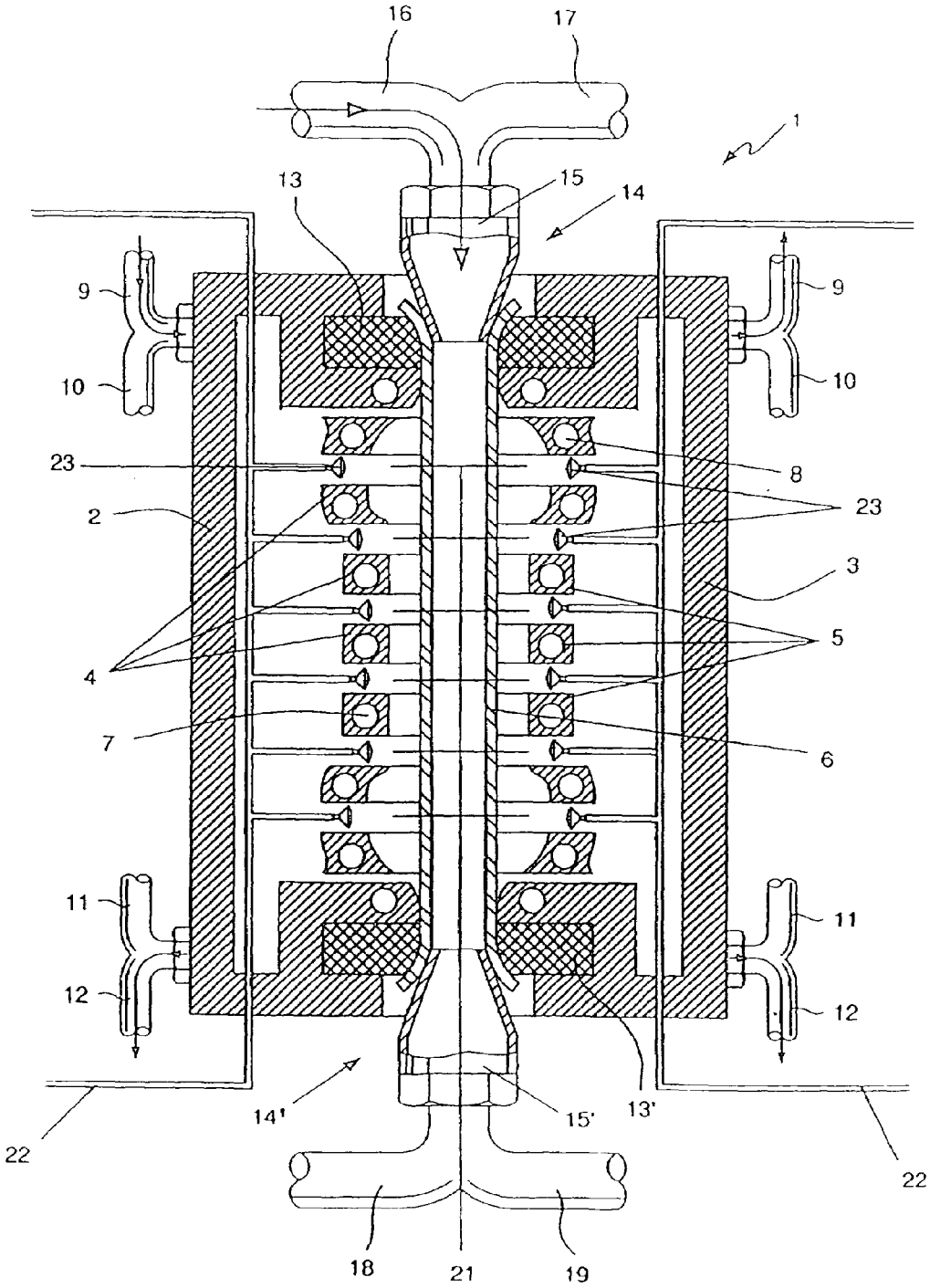
FIG. 1 is a schematic drawing showing a section view of the apparatus.
Figure 2:
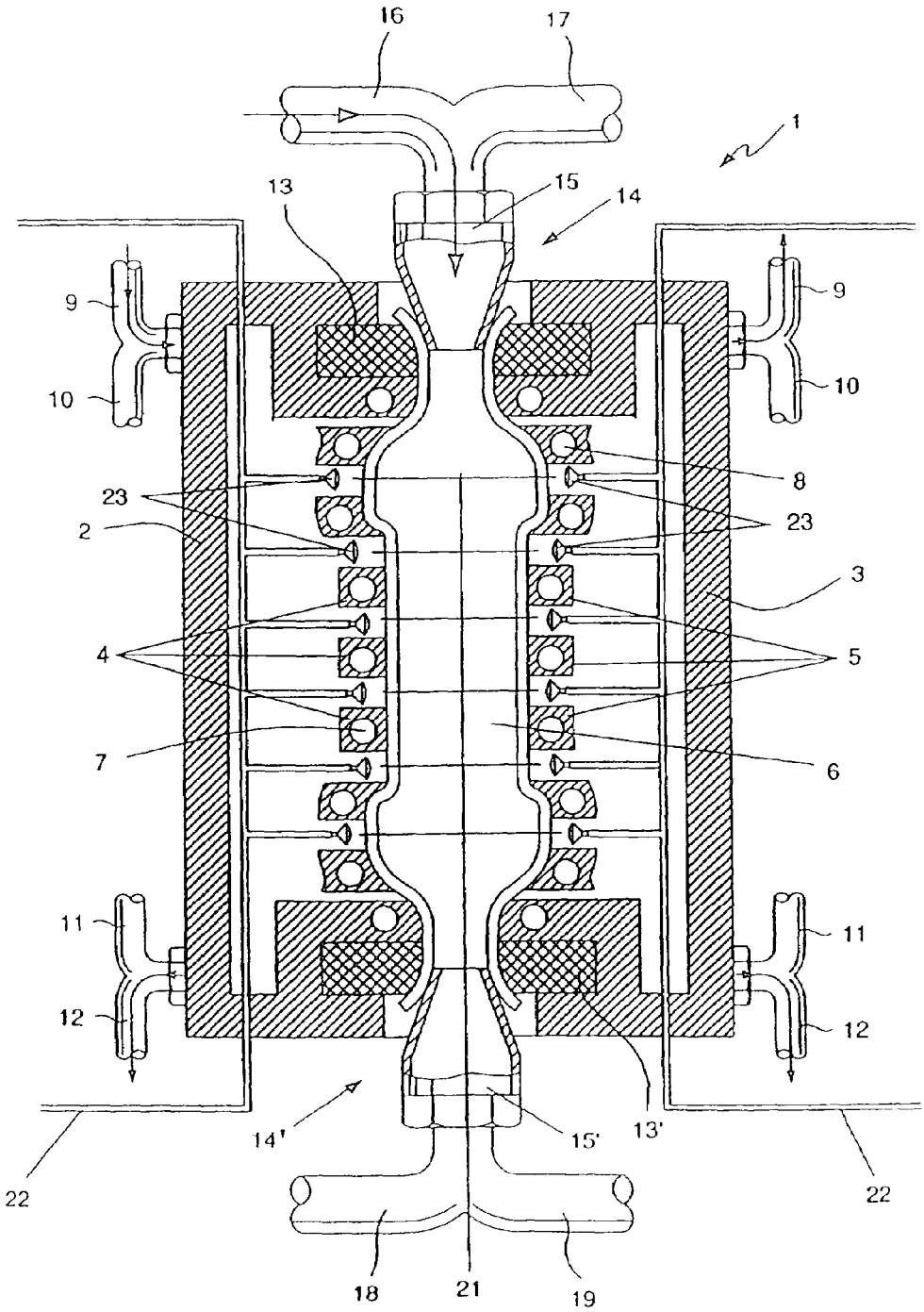
FIG. 2 is a second section view of the apparatus of FIG. 1 during the blow molding process.

Referring to the drawings and initially to FIGS. 1 and 2, there is shown a molding tool indicated generally by the reference numeral 1 in the form of two interacting tool halves 2, 3 in which are arranged respective support fingers 4, 5 for forming an essentially smooth cylindrical hollow casing billet 6 inserted between them which is preheated and intended to be molded against the inner walls of support fingers 4, 5 through the introduction of air to its interior. This hollow casing billet 6 comprises a thin-walled tube open at the ends.

Channels 7, 8 are arranged in each half 2, 3 of the moulding tool 1 for the circulation of either warm or cold water through the support fingers 4, 5 for heating or cooling respectively of the moulding tool 1 during the moulding process. For feeding in and removing this medium, one end of the respective channel 7, 8 is connected partly to a first inlet pipe 9 for the heating medium that can comprise, for example, heated liquid or steam, and partly to a second inlet pipe 10 for the cooling medium that preferably comprises water. Similarly, the other end of the said channels 7, 8 is connected partly to a first outlet pipe 11 for the cooling medium and partly to a second outlet pipe 12 for the heating medium. The said inlet and outlet pipes also have their associated respective controlling device, not shown in the figures, for steering the flow between the first and the second inlet pipes 9, 10 so that one can select whether either the heating medium or the cooling medium will flow through channels 7, 8. In this way, the flow through the respective channels 7, 8 in the moulding tool halves 2, 3 can very quickly be switched so that the flow very efficiently heats or cools the moulding tool 1 depending on whether the flow comprises the heating medium or the cooling medium.

In addition, the molding tool 1 or, more specifically, its respective halves 2, 3 are provided with slots or apertures 21. A hose 22 and a number of dispensers 23 mounted on the hose are also incorporated into each half 2, 3 of the tool 1. The dispensers 23 are mounted so as to align with the slots 21 and extend into the slots 21 to locate adjacent the external surface of the hollow casing billet 6. Separable sealing rings 13, 13' are mounted at their first and second inlet positions designated 14, 14' for respective nozzles 15, 15' intended for introducing the medium to the interior of the hollow casing billet 6 as well as leading this medium away via the open ends of the hollow casing billet 6.

A first inlet pipe 16 for a medium is partly connected to one of the nozzles 15, as is a second inlet pipe 17 for another medium, where in both cases, the medium preferably comprises air. The other nozzle 15' is partly connected to a first outlet pipe 18 for the medium and partly to a second outlet pipe 19 for the second medium. The said inlet pipes 16, 17 and outlet pipes 18, 19 also have their associated respective controlling device, not shown in the figures, for steering the flow between the said pipes so that the alternative flow paths at the inlet respectively outlet can be selected. In addition, both nozzles 15, 15' can, of course, be closed-off so that no medium can flow through them.

Figure 3:
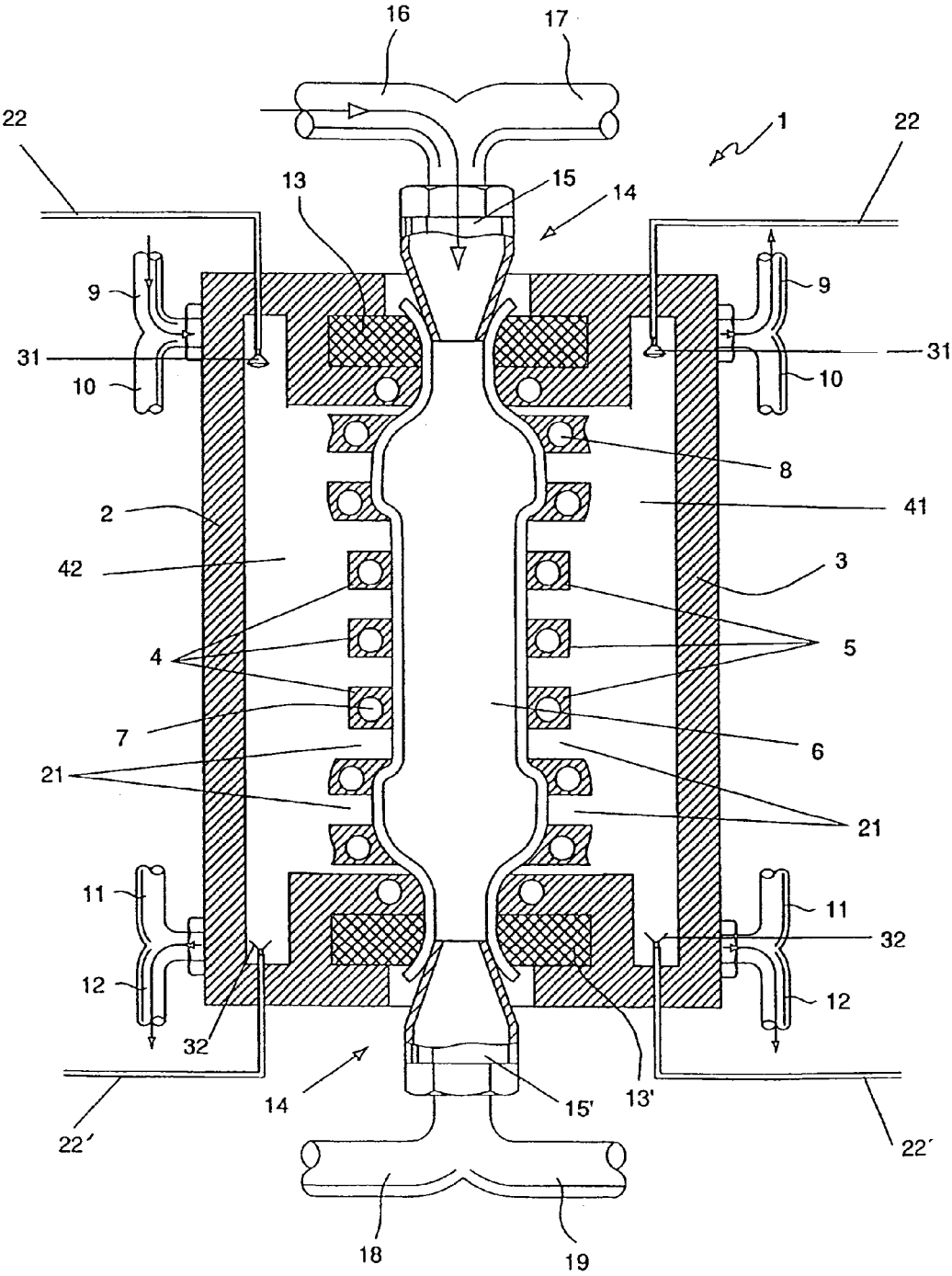
FIG. 3 is a section view of a second embodiment of the apparatus in accordance with the invention.

Referring to the drawings and now to FIG. 3, there is shown a second embodiment in accordance with the invention. A number of inlet hoses 22 provide cooling gas from a source (not shown) and each hose 22 is connected to an inlet valve 31 mounted in the internal cavities 41, 42 of the tool halves 2, 3. A number of outlet valves 32 are also located in the internal cavities 41, 42 of the tool halves 2, 3 and each outlet valve 32 is mounted on an outlet hose 22'. The outlet hoses 22' are connected to suction pumps (not shown) for removing cooling gas prior to separation of the tool 1 for removal of the casing 6.

In use, the hollow casing billet 6, is heated to quenching temperature between 775 and 1000° C. As illustrated in FIG. 1, the heated smooth hollow casing billet 6 is introduced between the halves 2, 3 of the molding tool 1 and these are pressed against each other to a position that produces a support frame. Following this, the nozzles 15, 15' are introduced into openings at each end of the hollow casing whereby the sealing between the respective end and nozzle 15, 15' takes place by means of the sealing rings 13, 13'. When the medium is introduced into the interior of the hot hollow casing billet 6 via nozzle 15, as illustrated by the directional arrow in FIG. 1, the billet is molded against the inner walls of the support fingers 4, 5.

To thereafter achieve a cooling that is efficient for carrying out the quenching process, the hollow casing billet 6 is quickly cooled on the outside. Cooling liquid is supplied via the hose 22 and the dispensers 23 and flushed directly onto the exposed external surface of the hollow casing 6. Alternatively, cooling gas may be injected into the internal cavities 41, 42 of the tool 1 after the billet 6 has been formed against the inner walls of the support fingers 4, 5 (See FIG. 3). At the same time, the halves 2, 3 of the tool 1 are cooled by an essentially cooling medium, preferably water, being led through the channels 7, 8 of these halves 2, 3.

It will of course be understood that the invention is not limited to the specific details as herein described, which are given by way of example only, and that various alterations and modifications may be made without departing from the scope of the invention as defined in the appended claims.

What is claimed is:

1. An apparatus for applying a cooling medium to an external surface of a blow molded metallic casing comprising a molding tool defining a plurality of cooperating inner molding walls to define a mold cavity, adjacent cooperating inner molding walls being spaced axially from one another to define at least one aperture therebetween and delivery means for delivering a cooling medium to each at least one aperture of the molding tool.

2. An apparatus as claimed in claim 1, wherein each inner molding wall being provided by a pair of opposed support fingers.

3. An apparatus as claimed in claim 1, wherein the delivery means is provided by a pipe and at least one dispenser.

4. An apparatus as claimed in claim 3, wherein the at least one dispenser is a plurality of dispensers aligned with and at least one of the plurality of dispensers being located adjacent each at least one aperature of the tool.

5. An apparatus as claimed in claim 1, wherein the tool is provided by two partible halves which combine to form a helical pipe.

6. An apparatus as claimed in claim 5, wherein the helical pipe is hollow and transports a cooling/heating medium internally.

7. An apparatus as claimed in claim 1, wherein the tool includes a chamber in fluid communication with each at least one aperture.

8. An apparatus as claimed in claim 7, wherein the delivery means is provided by one pipe having an inlet valve and another pipe having an outlet valve.

9. An apparatus as claimed in claim 8, wherein the inlet and outlet valves are in fluid communication with the chamber.

10. An apparatus as claimed in claim 9, wherein the tool is provided by two partible halves which combine to form a helical pipe.

11. An apparatus as claimed in claim 10, wherein the helical pipe is hollow and transports a cooling/heating medium internally.

12. An apparatus for applying a cooling medium to an external surface of a blow molded casing comprising a molding tool defining at least one aperture and delivery means for delivering a cooling medium to the at least one aperture of the molding tool, the delivery means is provided by one pipe having an inlet valve and another pipe having an outlet valve.

13. An apparatus for applying a cooling medium to an external surface of a blow molded casing comprising a molding tool defining at least one aperture and delivery means for delivering a cooling medium to the at least one aperture of the molding tool, the tool is provided by two partible halves which combine to form a helical pipe.

14. An apparatus as claimed in claim 13, wherein the helical pipe is hollow and transports a cooling/heating medium internally.

15. An apparatus for applying a cooling medium to an external surface of a blow molded casing comprising a molding tool defining at least one aperture and delivery means for delivering a cooling medium to the at least one aperture of the molding tool, the at least one aperture is at least one slot.

* * * * *

UNITED STATES PATENT AND TRADEMARK OFFICE

CERTIFICATE OF CORRECTION

PATENT NO. : 6,976,376 B2
DATED : December 20, 2005
INVENTOR(S) : Anders Sundgren et al.

It is certified that error appears in the above-identified patent and that said Letters Patent is hereby corrected as shown below:

Title page,
Item [56], References Cited, FOREIGN PATENT DOCUMENTS,
"JP 62259230A 7/1966" should read -- JP 61159230A 7/1986 --.

Column 2,
Line 39, delete "th" and insert -- the --.

Signed and Sealed this

Second Day of May, 2006

JON W. DUDAS
*Director of the United States Patent and Trademark Office*